US008672672B2

(12) United States Patent
LaVoie

(10) Patent No.: US 8,672,672 B2
(45) **Date of Patent: *Mar. 18, 2014**

(54) OIL BURNING SYSTEM

(75) Inventor: Eric T. LaVoie, Medway, MA (US)

(73) Assignee: Energy Efficiency Solutions, LLC, Holliston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/244,545

(22) Filed: Sep. 25, 2011

(65) Prior Publication Data

US 2012/0015310 A1 Jan. 19, 2012

Related U.S. Application Data

(63) Continuation of application No. 12/231,604, filed on Sep. 5, 2008, now Pat. No. 8,052,418.

(51) Int. Cl.
*F23N 1/00* (2006.01)

(52) U.S. Cl.
USPC ..... 431/38; 431/28; 431/36; 431/75; 431/80; 431/207

(58) Field of Classification Search
USPC ..... 431/28, 36, 75, 80, 207, 38
See application file for complete search history.

(56) References Cited

U.S. PATENT DOCUMENTS 1,922,656 A 8/1933 Berdon
2,290,337 A 7/1942 Knauth
2,876,830 A 3/1959 Duy
3,065,766 A 11/1962 Wenzl
3,272,441 A 9/1966 Davis, Sr. et al.
3,672,398 A 6/1972 Ichiryu et al.
3,758,258 A 9/1973 Kölhi
3,804,333 A 4/1974 Kramer et al.
3,852,022 A 12/1974 Medeot et al.
3,914,094 A 10/1975 Landry
4,047,879 A 9/1977 Mitchell et al.
4,141,505 A 2/1979 Reich
4,162,887 A 7/1979 Gray
4,249,885 A 2/1981 Reich
4,273,158 A * 6/1981 Chun ..... 138/30
4,298,338 A 11/1981 Babington
4,391,580 A 7/1983 Hunsberger et al.
4,392,810 A 7/1983 Bears et al.
4,392,820 A 7/1983 Niederholtmeyer
4,402,664 A 9/1983 Kutrieb
4,487,571 A 12/1984 Robertson et al.
4,526,523 A 7/1985 Parker
4,749,122 A 6/1988 Schriver et al.
4,759,312 A 7/1988 Pletzer
4,780,076 A 10/1988 Davis
4,797,089 A 1/1989 Schubach et al.
4,877,395 A 10/1989 Schubach et al.
5,000,677 A 3/1991 Lathion et al.
5,058,512 A 10/1991 Specht (Continued)

*Primary Examiner* — Kenneth Rinehart
*Assistant Examiner* — Jorge Pereiro
(74) *Attorney, Agent, or Firm* — McLane, Graf, Raulerson & Middleton, Professional Association

(57) ABSTRACT

The present disclosure is directed to an oil burning system, capable of burning various waste oils and other fuel oils, with high efficiency burn, reduced emissions, and without producing sludge within the system. Generally, the system operates by pressurizing liquid fuel to a ultra-high pressure and delivering the fuel through a two-stage filtration system, pre-heating the fuel, dispensing the fuel through a nozzle and igniting the fuel.

21 Claims, 1 Drawing Sheet

(56) References Cited

U.S. PATENT DOCUMENTS

| | | | | | |
|---|---|---|---|---|---|
| 5,149,260 | A | | 9/1992 | Foust | |
| 5,170,727 | A | * | 12/1992 | Nielsen | 110/346 |
| 5,221,043 | A | | 6/1993 | Hardy | |
| 5,240,405 | A | | 8/1993 | Schubach et al. | |
| 5,360,334 | A | | 11/1994 | Kagi, Sr. | |
| 5,408,970 | A | | 4/1995 | Burkhard et al. | |
| 5,464,328 | A | | 11/1995 | Stoeger | |
| 5,752,380 | A | | 5/1998 | Bosley et al. | |
| 5,873,235 | A | | 2/1999 | Bosley et al. | |
| 6,004,127 | A | | 12/1999 | Heimberg et al. | |
| 6,059,560 | A | | 5/2000 | Richards et al. | |
| 6,070,404 | A | | 6/2000 | Bosley et al. | |
| 6,095,028 | A | | 8/2000 | Lamas et al. | |
| 6,098,894 | A | | 8/2000 | Ohta et al. | |
| 6,132,203 | A | | 10/2000 | Masin | |
| 6,230,685 | B1 | * | 5/2001 | Kilgore et al. | 123/467 |
| 6,485,632 | B1 | | 11/2002 | Ward | |
| 6,619,314 | B2 | * | 9/2003 | Wynn et al. | 137/454.6 |
| 7,435,082 | B2 | | 10/2008 | Jayne | |
| 7,850,445 | B2 | | 12/2010 | Bechard | |
| 8,052,418 | B2 | * | 11/2011 | LaVoie | 431/28 |
| 2004/0241602 | A1 | | 12/2004 | Bechard | |
| 2006/0127831 | A1 | | 6/2006 | Kagi, Sr. | |
| 2007/0099135 | A1 | | 5/2007 | Schubach | |
| 2008/0305445 | A1 | * | 12/2008 | Roberts et al. | 431/9 |
| 2010/0062384 | A1 | | 3/2010 | LaVoie | |

* cited by examiner

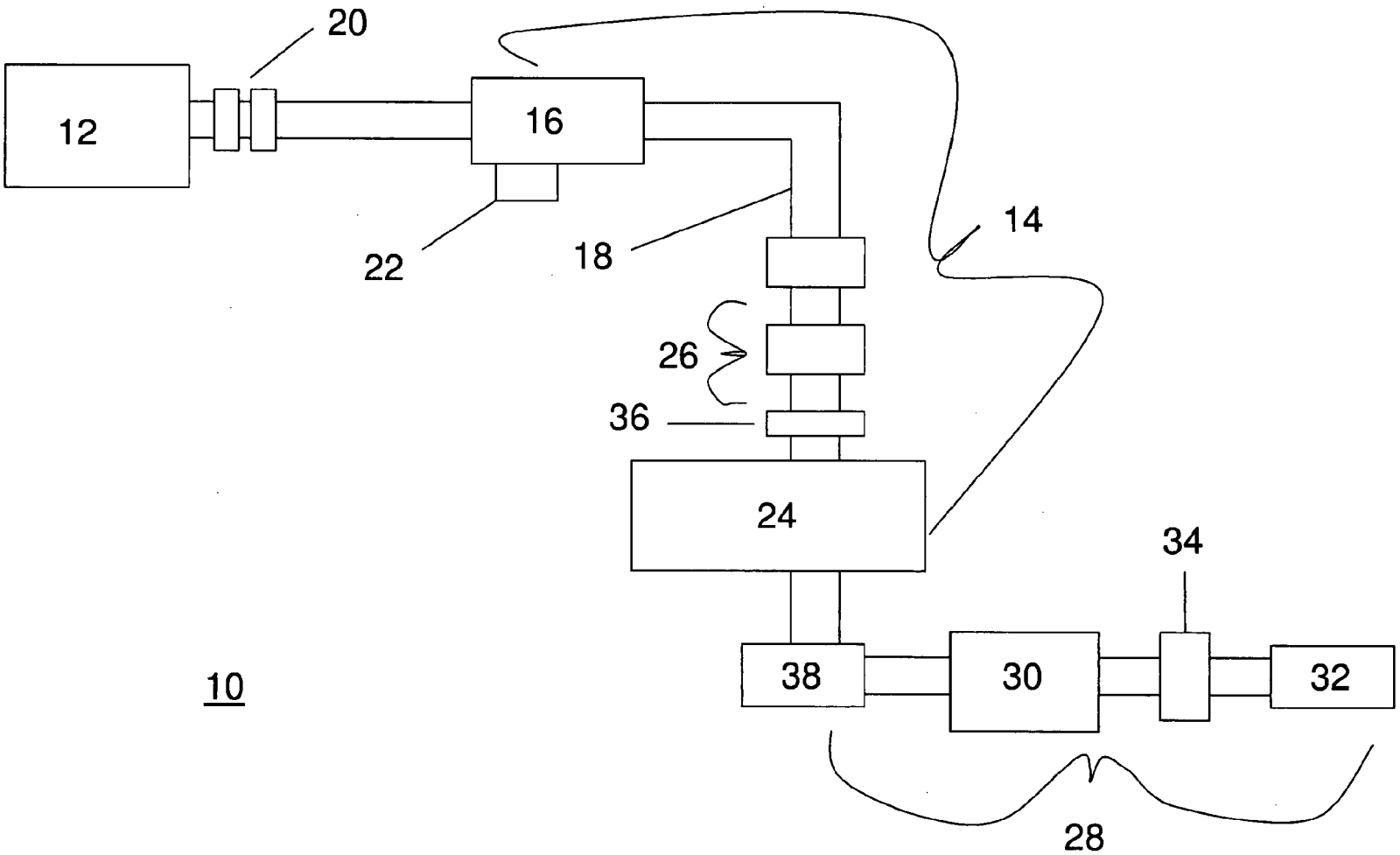
12
20
16
22
18
14
26
36
24
38
30
34
32
28
10

OIL BURNING SYSTEM

CROSS-REFERENCE TO RELATED APPLICATIONS

This application claims priority as a continuation application under 35 U.S.C. §120 to U.S. patent application Ser. No. 12/231,604, filed Sep. 5, 2008, currently pending. The aforementioned application is incorporated herein by reference in its entirety.

BACKGROUND

The present disclosure generally relates to an oil burning system, and more particularly to a system that is capable of maintaining Ultra-high-pressure while reducing their current fuel usage to generate an equivalent quantity of heat as prior systems, while minimizing volume requirements of fuel and pollutants.

With rising "Heating-oil" prices, consumers have become more cost and efficiency conscious. Homeowners who choose to heat their home or business with regular heating oil can opt to also use other fuel oils and other waste oils blends as fuel for the heating system. However, existing waste-oil burning systems are relatively inefficient and generate a high level of pollution as these systems burn only about 75-85% of the fuel, while 15% (or more) of the fuel is not burned and is exhausted as soot plus carbon monoxide. Further, existing systems require the fuel to be heated to about 190-250° F., the heating process creates sludge in the system; this, in turn, requires disassembly of the system for cleaning, and disposal of the sludge.

SUMMARY

The present disclosure, as illustrated herein, is clearly not anticipated, rendered obvious, or even present in any of the prior art mechanisms, either alone or in any combination thereof.

In one aspect, the present disclosure provides an oil burning system that increases efficiency by reducing the amount of fuel usage through the presence of ultra-high pressure within the system, along with heating the fuel under the same ultra-high pressure.

In another aspect, the present disclosure provides an oil burning system with reduced emission of carbon monoxide, hydrogen sulfates and hydrocarbons, and without creating sludge as a byproduct of operation.

In still another aspect, the present disclosure provides an oil burning system that has the ability to automatically adjust the flame size to maintain a constant stack temperature to maximize efficiency.

According to one embodiment, the system in accordance with the present disclosure operates in the following manner: the fuel is pumped out of the storage tank by an ultra-high pressure pump which increases the pressure of the liquid fuel to approximately one thousand nine hundred pounds per square inch and passed through a two-stage high-pressure filter, into a pre-heat tank; after the fuel temperature is raised, the fuel is dispensed through a nozzle and is ignited. By monitoring the exhaust stack temperature of the system, and varying the pressure accordingly, optimal heating efficiency can be reached. Initially, when the system is cold, increasing the pressure substantially, allows the flame to burn at a higher level of efficiency than that of existing systems, while not increasing the volume of liquid fuel utilized. As the water temperature of the boiler rises, the pressure is gradually reduced. Optimal efficiency is reached by monitoring the stack temperature and adjusting the pressure to keep the stack temperature at about four hundred and ten degrees Fahrenheit—the pressure is reduced when the system detects the stack temperature above four hundred ten degrees Fahrenheit. Thus, monitoring the stack temperature and adjusting the pressure accordingly allows the system to use less fuel than existing systems (i.e. as little as half a gallon of fuel per hour) to deliver the same or better temperature as a 0.85 gallon per hour system.

There has thus been outlined, rather broadly, the more important features of the oil burner system in order that the detailed description thereof that follows may be better understood, and in order that the present contribution to the art may be better appreciated. There are additional features of the presently disclosed system that will be described hereinafter.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

For a better understanding of the present disclosure, its operating advantages and the specific objects attained by its uses, reference should be made to the accompanying drawings and descriptive matter in which there are illustrated preferred embodiments.

BRIEF DESCRIPTION OF THE DRAWINGS

FIG. 1 illustrates a block diagram of an exemplary oil-burning system in accordance with the present disclosure, wherein the system includes a storage device, a filtration system and a distribution system such that each component is in fluid communication with each other via a fuel line.

DETAILED DESCRIPTION OF THE PREFERRED EMBODIMENTS

The present disclosure relates to all oil burning system, and more particularly to a home heating oil booster pump system that substantially increases the efficiency and burning capabilities of existing systems by reducing overall usage of oil while maintaining the same heat output, along with reducing the amount of pollution created by the system. It is known in the art that most existing oil burning systems, including but not limited to home heating systems, operate at only seventy-five to eight-five percent efficiency. Thus, existing systems waste at least fifteen percent of oil burning due to incomplete burning of fuel with waste products such as soot, carbon monoxide and other pollutants. Therefore, the present system increases the efficiency of oil burning by having more completely burned fuel, along with reducing waste products during the burning process and therefore requiring less oil to generate the same amount of heat as pre-existing systems through the use of ultra-high-pressure, effective fuel flow and the elimination of the creation of any sludge throughout the process.

FIG. 1 illustrates a high-efficiency oil burning system 10, wherein the system 10 is disposed to increase the oil burning capabilities of existing systems, by maintaining high-pressure throughout the system 10 and allowing for more effective fuel flow, among other things. The overall system 10, includes a storage device 12 for housing liquid to be used within the system 10; in the preferred embodiment, the oil burning system 10 utilizes number two heating oil, however in alternate embodiments the system 10 allows for the burning of a combination of number two heating oil with various other waste oil, including but not limited to bio fuels and light grease, waste and virgin paint solvents, waste and virgin cleaning solvents, and diesel, kerosene and hydraulic oils. More preferably, the system 10 allows for up to fifty percent waste oil in combination with the burning of number two heating oil, wherein the waste oil may be a single composition itself, or a combination of the waste oils listed above, given that they do not comprise more than fifty percent of the overall liquid within the system 10.

The system 10 further includes a filtration system 14, wherein the filtration system 14 substantially removes impurities from the liquid housed within the storage device 12. The filtration system 14 comprises a pump 16, wherein the pump 16 is in fluid communication with the storage device 12 via a fuel line 18 enabling the introduction of liquid from the storage device 12 into the filtration system 14 for high pressure purification. The system 10 also includes a first pair of filters 20 located substantially between the storage device 12 and the pump 16 of the filtration system 14, wherein the filters 20 are in fluid communication with the storage device 12 and the pump 16 via the fuel line 18. In the preferred embodiment, the first pair of filters 20 is arranged in a substantially tandem orientation and in a canister style.

The pump 16 located within the filtration system 14 maintains high pressure throughout the system 10, thereby creating a more efficient fuel flow throughout the system 10, while also preventing the build-up of any sludge during the heating in the system 10. In the preferred embodiment, the pump 16 is operable in a range of two hundred to three thousand two hundred pounds per square inch, and more preferably, the pump 16 is operable in a range of one thousand to two thousand two hundred pounds per square inch. The pump 16 includes a variable pressure control 22, wherein the control 22 regulates the exhaust temperature or stack temperature of the overall system 10 for more efficient fuel usage, preferably around four hundred ten degrees Fahrenheit; it is known in the art that a stack temperature above this range creates waste and inefficiency within a system once the boiler is heated up to eighty percent of capacity. Furthermore, the system 10 can be automatically controlled by setting the overall stack temperature, alternatively, an individual may manually control the system to set the pressure of the system for each desired fuel and burn usage.

Additionally, the filtration system 14 includes a pre-heater 24, wherein the pre-heater 24 is in fluid communication with the pump 16 via the fuel line 18. The pre-heater 24 operates at a high pressure to maintain efficient fuel viscosity through out the system and prevent the formulation of any sludge or impurities within the liquid. In the preferred embodiment, the pre-heater 24 operates between three hundred and two thousand five hundred pounds per square inch, wherein the pressure is adjustable depending on the desired viscosity of the liquid. Therefore, the pre-heater 24 serves the purpose of heating the liquid to the desired temperature and viscosity for use in the system 10. Moreover, in the preferred embodiment, the pre-heater 24 operates at a temperature range between seventy and one hundred ninety degrees Fahrenheit, wherein the individual utilizing the system may determine the specific temperate setting.

Furthermore, a second filter 26 is disposed between the pre-heater 24 and the pump 16, wherein the filter 26 is in fluid communication with the pump 16 and the pre-heater 24 via the fuel line 18. Preferably the second filter 26 comprises a two stage high-pressure micron filter with mesh that allows for the removal of any liquid in a semi-solid state, thereby creating an extremely liquefied material for introduction into the pre-heater 24. More preferably the second filter 26 operates at up to three thousand five hundred pounds per square inch to remove impurities from the liquid while continually maintaining the pressure created by the pump 16. The second filter 26 allows for substantially clean and sludge-free passage of the liquid through the remaining components of the system and prevents clogging, while allowing for individual components to be in use longer, but most importantly to prevent sludge from building up within the system 10. The filtration system 14 also includes an even pressure accumulator 36 as known in the art, wherein the accumulator is located substantially between the second filter 26 and the pre-heater 24, such that the accumulator 36 is in fluid communication with the second filter 26 and the pre-heater 24 via the fuel line 18. The accumulator maintains and ensures steady pressure distribution throughout the system 10.

Lastly, the system 10 includes a distribution system 28, wherein the distribution system 28 is disposed to deliver the liquid to a boiler or furnace, preferably for heating a residential or commercial dwelling. The distribution system 28 further comprises a motor control 30 along with a nozzle assembly 32 for distribution of the liquid from the system 10. The system 10 also includes a valve 34 disposed after the motor control 30 and the pre-heater 24, wherein the valve 34 is preferably a one hundred ten volt electrical solenoid valve that is operable at up to two thousand eight hundred pounds per square inch. The valve 34 is in fluid communication with the pre-heater 24 and the control motor 30 via the fuel line, and wherein the control motor is in fluid communication with the nozzle assembly 32. The valve 34 operates in an on and off capacity, wherein the valve is in electrical communication with the variable control 22 to regulate the overall system 10. Moreover, a third filter 38 is located substantially between the valve 34 and the pre-heater 24 for removal of any remaining particles in the fuel or any sludge that has built up prior to distribution through the nozzle 32.

Furthermore, it is known in the art that existing oil burning systems, including but not limited to those for heating residential dwellings, create sludge during the process of oil burning and as a result, this creates two significant problems, one being that the system itself requires regular maintenance and cleaning, and two, that some of the oil in the system becomes a waste by-product thereby reducing the efficiency of the overall system. Therefore, as described above the system in accordance with the present disclosure does not require the use of a sludge collector and/or a blow down tank to remove sludge from the system since none is created by maintaining high pressure throughout the system, and additionally the second pair of filters 26 removes any remaining semi-solid particles that may have formed. Moreover, the system 10 creates a more effective flow of atomized fuel, and as a result of the lack of sludge creation, it is not necessary for the introduction of an external air supply, such as an air compressor to be incorporated into the system to atomize, clean and remove any sludge that has built up through operation. In addition, known pollutants and by-products of oil burning systems such as carbon monoxide and hydrogen sulfate are reduced substantially over current systems.

Moreover it is known in the art that an oil burning system maintaining a stack temperature above four hundred ten degrees Fahrenheit creates waste and leads to inefficiency; current systems tend to operate in the range of four hundred seventy-five to six hundred degrees Fahrenheit while operating ten to twenty-five percent inefficiently. Conversely, the present disclosure allows for the stack temperature to be regulated through the pressure control 22, wherein if the system 10 generates a stack temperature on average about four hundred ten degrees Fahrenheit, the pressure and the stack temperature in the system can be reduced to prevent inefficiency while also limiting oil usage.

To demonstrate the feasibility of the system in accordance with the present disclosure, several tests were performed outlining how by substantially increasing pressure throughout the entire system and monitoring the stack temperature of the system, the overall usage of oil is reduced while simultaneously maintaining output. The below examples reveal data of the presently disclosed system versus conventional and existing oil burning systems, wherein the overall usage of oil was reduced in each instance. Furthermore, as demonstrated below, the present disclosure also allows for a reduction in the pollutants given off by conventional oil burning systems, specifically carbon monoxide and hydra-sulfides.

EXAMPLE 1

To demonstrate the feasibility of the system in accordance with the present disclosure, the system 10 was compared against a two year old Burnham oil burner with a nozzle possessing a dispensing capacity of nine-tenths of gallon of oil per hour. Each system was tested to determine the time and oil usage necessary to raise the water temperature of the boiler from seventy to one hundred eighty five degrees Fahrenheit. Multiple variables were monitored during this process, including overall time lapse, the stack temperature of the system, the rate of oil usage, the pressure in the overall system and the water temperature. Table 1 represents the current system on the same Burnham boiler and Table 2 represents the Burnham oil boiler with an un-modified same new standard burner; the tables clearly show that it takes the present system fifty-nine minutes and 0.62 gallons of oil to raise the water temperature to one hundred eight five degrees Fahrenheit, whereas the Burnham oil boiler takes forty-seven minutes and 0.71 gallons of oil. Furthermore, as evidenced from the tables, the usage rate of the present system dropped to half a gallon per hour when the temperature reached one hundred eighty five degrees Fahrenheit, thereby creating a more efficient system, while also maintaining the stack temperature consistently around four hundred ten degrees Fahrenheit, thereby eliminating inefficiency as described above.

TABLE 1

| Time | Stack Temp | Gallons per Hour Usage | PSI | Water Temp (F.) |
|---|---|---|---|---|
| 0 | 60 | 0 | 0 | 70 |
| 1 min | 320 | 0.8 | 1600 | 74 |
| 5 min | 390 | 0.75 | 1500 | 85 |
| 10 min | 413 | 0.7 | 1100 | 92 |
| 15 min | 423 | 0.66 | 850 | 109 |
| 20 min | 425 | 0.6 | 750 | 130 |
| 30 min | 421 | 0.59 | 700 | 151 |
| 40 min | 422 | 0.58 | 650 | 168 |
| 50 min | 420 | 0.58 | 600 | 179 |
| 60 min | 418 | 0.5 | 475 | 185 |

TABLE 2

| Time | Stack Temp | Gallons per Hour Usage | PSI | Water Temp (F.) |
|---|---|---|---|---|
| 0 | 60 | 0 | 0 | 70 |
| 1 min | 410 | 0.9 | 140 | 76 |
| 5 min | 460 | 0.9 | 140 | 88 |
| 10 min | 508 | 0.9 | 140 | 97 |
| 15 min | 531 | 0.9 | 140 | 116 |
| 20 min | 552 | 0.9 | 140 | 140 |
| 30 min | 568 | 0.9 | 140 | 160 |
| 40 min | 571 | 0.9 | 140 | 178 |
| 50 min | 574 | 0.9 | 140 | 185 |

EXAMPLE 2

To demonstrate the feasibility of the presently disclosed system, the system 10 was compared against a two year old Burnham oil burner with a nozzle possessing a dispensing capacity of one and one-quarter gallons of oil per hour. Each system was tested to determine the time and oil usage necessary to raise the water temperature of the boiler from seventy to one hundred eighty five degrees Fahrenheit. Multiple variables were monitored during this process, including overall time lapse, the stack temperature of the system, the rate of oil usage, the pressure in the overall system and the water temperature. Table 3 represents the current system and Table 4 represents the Burnham oil boiler; the tables clearly show that it takes the present system fifty-nine minutes and 0.62 gallons of oil to raise the water temperature to one hundred eight five degrees Fahrenheit, whereas the Burnham oil boiler takes forty-three minutes and 0.89 gallons of oil. Furthermore, as evidence from the tables, the usage rate of the present system dropped to half a gallon per hour when the temperature reached one hundred eighty five degrees Fahrenheit, thereby creating a more efficient system, while also maintaining the stack temperature consistently around four hundred ten degrees Fahrenheit, thereby eliminating inefficiency as described above.

TABLE 3

| Time | Stack Temp | Gallons per Hour Usage | PSI | Water Temp (F.) |
|---|---|---|---|---|
| 0 | 60 | 0 | 0 | 70 |
| 1 min | 320 | 0.8 | 1600 | 74 |
| 5 min | 390 | 0.75 | 1500 | 85 |
| 10 min | 413 | 0.7 | 1100 | 92 |
| 15 min | 423 | 0.66 | 850 | 109 |
| 20 min | 425 | 0.6 | 750 | 130 |
| 30 min | 421 | 0.59 | 700 | 151 |
| 40 min | 422 | 0.58 | 650 | 168 |
| 50 min | 420 | 0.58 | 600 | 179 |
| 60 min | 418 | 0.5 | 475 | 185 |

TABLE 4

| Time | Stack Temp | Gallons per Hour Usage | PSI | Water Temp (F.) |
|---|---|---|---|---|
| 0 | 60 | 0 | 0 | 70 |
| 1 min | 440 | 1.25 | 140 | 77 |
| 5 min | 490 | 1.25 | 140 | 97 |
| 10 min | 525 | 1.25 | 140 | 109 |
| 15 min | 552 | 1.25 | 140 | 121 |
| 20 min | 577 | 1.25 | 140 | 148 |
| 30 min | 585 | 1.25 | 140 | 163 |
| 40 min | 609 | 1.25 | 140 | 182 |
| 50 min | 611 | 1.25 | 140 | 185 |

EXAMPLE 3

To demonstrate the feasibility of the presently disclosed system, measurements for both the level of carbon monoxide and hydro sulfides existing the various systems were taken and shown in detail below. Table 5 represents the present system at different fuel usages; Table 6 represents the Burnham oil boiler with different nozzle assemblies and usages, exhibiting existing home heating oil systems. As the below data clearly illustrates, the amount of pollutants released by the system in accordance with the present disclosure is dramatically reduced in comparison to existing systems.

TABLE 5

| Fuel Usage (gal/hr) | Carbon Monoxide (ppm) | Hydro Sulfides (ppm) |
|---|---|---|
| 0.56 | 10.5 | 55 |
| 0.75 | 8.5 | 61 |
| 0.85 | 7.8 | 76 |
| 1 | 7.1 (cold) | 74 (cold) |
| | 6.4 (hot) | 70 (hot) |
| 1.25 | 8.5 | 96 (cold) |
| | | 91 (ppm) |

TABLE 6

| Fuel Usage (gal/hr) | Carbon Monoxide (ppm) | Hydro Sulfides (ppm) |
|---|---|---|
| 0.75 | 55 | 310 |
| 0.85 | 68 | 390 |
| 1.0 | 92 (cold) | 415 (cold) |
| | 88 (hot) | 400 (hot) |
| 1.25 | 135 | 615 (cold) |
| | | 595 (hot) |

What is claimed is:

1. An apparatus for increasing the efficiency of an oil burning system, comprising:

a pump having a pump inlet and a pump outlet, the pump inlet in fluid communication with a source of oil based fuel, said pump for receiving the oil based fuel at the pump inlet at a first pressure and discharging the oil based fuel through the pump outlet at a second pressure higher than the first pressure, wherein the second pressure is at least 200 psi;

an accumulator having an accumulator inlet in fluid communication with the pump outlet and an accumulator outlet, said accumulator for absorbing pulsations in the oil based fuel discharged by said pump;

a pre-heater having a pre-heater inlet in fluid communication with the accumulator outlet and a pre-heater outlet, said pre-heater for heating the oil based fuel to one or both of a desired temperature and a desired viscosity; and an oil burner nozzle in fluid communication with the pre-heater outlet for receiving and atomizing the oil based fuel and delivering the oil based fuel to a burner.

2. The apparatus of claim 1, wherein the burner is the burner of an associated boiler.

3. The apparatus of claim 1, wherein the oil burning system is a home heating system.

4. The apparatus of claim 1, wherein the second pressure is in the range of 200 to 3,200 psi.

5. The apparatus of claim 4, wherein the second pressure is in the range of 1000 to 2,200 psi.

6. The apparatus of claim 1, further comprising:

a first valve having a first valve inlet in fluid communication with the pre-heater outlet and a first valve outlet in fluid communication with said oil burner nozzle, said first valve for selectively controlling a flow of the oil based fuel to said oil burner nozzle.

7. The apparatus of claim 6, further comprising:

a first filter assembly inlet in fluid communication with the pre-heater outlet, a first filter assembly outlet in fluid communication with the first valve inlet, and one or more filter elements for removing impurities from the oil based fuel.

8. The apparatus of claim 7, further comprising:

a second filter in fluid communication with said pump and said pre-heater.

9. The apparatus of claim 1, further comprising:

a variable pressure control for controlling operation of the pump responsive to changes in an exhaust stack temperature.

10. The apparatus of claim 9, further comprising:

said variable pressure control operable to control operation of the pump to decrease the second pressure when the exhaust stack temperature is above a pre-selected value.

11. The apparatus of claim 10, further comprising:

said variable pressure control operable to control operation of the pump to increase the second pressure when the exhaust stack temperature falls below the pre-selected value.

12. The apparatus of claim 10, wherein said preselected temperature is in the range of 370-410 degrees Fahrenheit.

13. The apparatus of claim 10, wherein the first valve is in electrical communication with the variable control to regulate the distribution of fuel from the oil burner nozzle.

14. The apparatus of claim 1, wherein the oil based fuel is selected from the group consisting of number two home heating oil, waste oil, and combinations thereof.

15. The apparatus of claim 14, wherein the waste oil is selected from the group consisting of biofuel, light grease, waste and virgin paint solvents, waste and virgin cleaning solvents, diesel, kerosene and hydraulic oils.

16. The apparatus of claim 14, wherein the amount of waste oil does not comprise more than fifty percent of the overall composition of the oil based fuel.

17. An oil burning system comprising:

a storage device for housing a quantity of oil based fuel for use within the system; and a distribution system, wherein the distribution system is disposed to deliver the oil based fuel to a burner, said distribution system comprising:

a pump having a pump inlet and a pump outlet, the pump inlet in fluid communication with an outlet of said storage device, said pump for receiving the oil based fuel at the pump inlet at a first pressure and discharging the oil based fuel through the pump outlet at a second pressure higher than the first pressure, wherein the second pressure is at least 200 psi;

an accumulator having an accumulator inlet in fluid communication with the pump outlet and an accumulator outlet, said accumulator for absorbing pulsations in the oil based fuel discharged by said pump;

a pre-heater having a pre-heater inlet in fluid communication with the accumulator outlet and a pre-heater outlet, said pre-heater for heating the oil based fuel to one or both of a desired temperature and a desired viscosity; and an oil burner nozzle in fluid communication with the pre-heater outlet for receiving and atomizing the oil based fuel and delivering the oil based fuel to the burner.

18. A method for improving the efficiency of an oil burning system of a type having a storage device housing a quantity of an oil based fuel, a burner, and a distribution system for delivering the oil based fuel to the burner, said method comprising:

pressurizing the oil based fuel using a pump having a pump inlet and a pump outlet, the pump inlet in fluid communication with the storage device, the pump receiving the oil based fuel at the pump inlet at a first pressure and discharging the oil based fuel through the pump outlet at a second pressure higher than the first pressure, wherein the second pressure is at least 200 psi;

delivering the oil based fuel at the second pressure from the pump to an accumulator to absorb pressure fluctuations in the oil based fuel;

pre-heating the oil based fuel exiting the accumulator to produce a flow of pre-heated oil based fuel having a steady, elevated pressure;

delivering the flow of pre-heated oil based fuel to an oil burner nozzle associated with the burner; and atomizing the flow of pre-heated oil based fuel with the oil burner nozzle.

19. The method of claim 18, further comprising:

monitoring an exhaust stack temperature of the oil burning system; and if the exhaust stack temperature is above a preselected temperature, controlling operation of the pump to decrease the second pressure.

20. The method of claim 19, further comprising:

if the exhaust stack temperature falls below the preselected temperature, controlling operation of the pump to increase the second pressure.

21. The method of claim 19, wherein the preselected temperature is between 370-410 degrees Fahrenheit.

* * * * *